US012471688B2

(12) United States Patent
Simmons, Jr.

(10) Patent No.: US 12,471,688 B2
(45) Date of Patent: Nov. 18, 2025

(54) DUAL-POWER PORTABLE-USE HAIR DRYER

(71) Applicant: Maurice T. Simmons, Jr., New Orleans, LA (US)

(72) Inventor: Maurice T. Simmons, Jr., New Orleans, LA (US)

( * ) Notice: Subject to any disclaimer, the term of this patent is extended or adjusted under 35 U.S.C. 154(b) by 846 days.

(21) Appl. No.: 17/067,405

(22) Filed: Oct. 9, 2020

(65) Prior Publication Data

US 2022/0110432 A1 Apr. 14, 2022

(51) Int. Cl.

| | |
|---|---|
| ***A45D 20/14*** | (2006.01) |
| ***A45D 20/24*** | (2006.01) |
| ***A45D 20/28*** | (2006.01) |
| ***A45D 20/30*** | (2006.01) |
| ***A45D 20/42*** | (2006.01) |

(52) U.S. Cl.
CPC ..... *A45D 20/14* (2013.01); *A45D 20/24* (2013.01); *A45D 20/28* (2013.01); *A45D 20/30* (2013.01); *A45D 20/42* (2013.01)

(58) Field of Classification Search
CPC ..... A45D 20/14; A45D 20/24; A45D 20/28; A45D 20/30; A45D 20/42; A45F 3/04
USPC ..... 392/380
See application file for complete search history.

(56) References Cited

U.S. PATENT DOCUMENTS 3,377,715 A * 4/1968 Hubner ..... A45D 20/18 D28/12
3,946,498 A * 3/1976 Waters ..... A45D 20/18 392/383
4,260,875 A * 4/1981 Walter ..... A45D 20/12 34/554
4,486,961 A * 12/1984 Giesselbach ..... A45D 20/08 34/100
4,850,264 A * 7/1989 Kiser ..... F24F 11/72 454/255
5,195,253 A 3/1993 Poumey et al.
5,787,601 A 8/1998 Stelly
6,431,457 B1 * 8/2002 Dirkes, II ..... F24H 15/33 236/11
7,096,597 B1 8/2006 Zellous
7,380,347 B2 6/2008 Coats et al.
8,146,264 B1 4/2012 Stefano et al.
(Continued)

FOREIGN PATENT DOCUMENTS

GB 2299755 A 10/1996

*Primary Examiner* — Sang Y Paik
(74) *Attorney, Agent, or Firm* — KEATY LAW FIRM LLC; Thomas S. Keaty

(57) ABSTRACT

A dual-power portable-use hair dryer system and method for drying hair providing a hair dryer which can be carried on the back or the side of a user who can be a person whose own hair is being dried or a person acting as a stylist drying the hair of others, which can be operated either on AC mains power or on an incorporated DC battery array, where AC mains operation provides free movement within the range of the AC cord and DC battery operation provides unlimited free movement, and where use with a soft bonnet hair-drying attachment allows hands-free use, and use by a stylist allows free movement from person to person. The dual-power portable-use hair dryer draws pre-heated air away from the electric and electronic components for the dual purposes of cooling the components and reducing the expenditure of energy through the heater.

9 Claims, 4 Drawing Sheets

(56) References Cited

U.S. PATENT DOCUMENTS

| | | | | |
|---|---|---|---|---|
| 2004/0071455 | A1* | 4/2004 | Allwohn | A45D 20/12<br>392/360 |
| 2004/0172847 | A1* | 9/2004 | Saida | A45D 20/12<br>34/96 |
| 2005/0091866 | A1 | 5/2005 | Attaway et al. | |
| 2019/0387860 | A1* | 12/2019 | Shami | A45D 1/04 |
| 2021/0307479 | A1* | 10/2021 | Conrad | A45D 20/122 |

* cited by examiner

DUAL-POWER PORTABLE-USE HAIR DRYER

BACKGROUND OF THE INVENTION

This invention provides a dual-power portable-use hair dryer system and method for drying hair providing a hair dryer which can be carried on the back or the side of a user and which can be operated either on AC mains power or DC battery power.

Currently available hair dryers claiming to be "portable" are only portable when they are not in use. They would more accurately be called "transportable." During the hair-drying operation the user is tethered in place and restricted from moving around. If the user could move around with the hair dryer, the user could perform other tasks while the hair is drying, instead of just waiting for the hair to dry. If the user is wearing a soft-bonnet type of hair-drying attachment, then the user's hands are free to perform other tasks.

Sometimes hair stylists are called upon to dry the hair of other people in locations away from the stylist's salon, for instance on movie or photo shoots or when working in healthcare or other facilities. During such work, it might be desirable for the stylist to be able to move from person to person instead of requiring everyone to come to the stylist's fixed location.

Currently available battery-operated hair dryers tend to be under-powered and capable of only short operating times which are not sufficient to fully dry and set long hair.

What is needed is a hair dryer that is truly portable even while being used, capable of operating either on AC mains power or on battery power of sufficient capacity for the job, capable of use with a soft bonnet and a blow-dry nozzle as needed, and providing maximum freedom of movement to users whose own hair is being dried and users who are drying the hair of others.

SUMMARY OF THE INVENTION

This invention provides a dual-power portable-use hair dryer system and method for drying hair providing a hair dryer which can be carried on the back or the side of a user who can be a person whose own hair is being dried or a person acting as a stylist drying the hair of others, which can be operated either on AC mains power or on an incorporated DC battery array, where AC mains operation provides free movement within the range of the AC cord and DC battery operation provides unlimited free movement, and where use with a soft bonnet hair-drying attachment allows hands-free use, and use by a stylist allows free movement from person to person.

A pack cover having at least one strap, an insulated standoff, and a pack vent encloses an air handler unit, a battery array, an AC-to-DC power unit, and a controller unit. Operation is controlled by the user through a user control in communication with the controller unit. The air handler unit has an intake hood covering an air intake with an inflow sensor, a heater, optionally an ionizer, a fan unit, an outflow sensor, and a flexible air hose which can be extended outside the pack cover and to which a hair-drying attachment such as a soft bonnet or blow-dry nozzle can be attached. The controller unit controls the charging of the battery array and controls the operation of the dual-power portable-use hair dryer within parameters set by the user through the user control. The controller unit obtains data in real time from the inflow sensor, outflow sensor, battery array, and AC-to-DC power unit, and controls the heater, fan unit, and optionally the ionizer. The intake hood and air intake are placed so as to collect air pre-heated by the electric and electronic components for the dual purposes of drawing heat away from the components and reducing the expenditure of energy through the heater.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
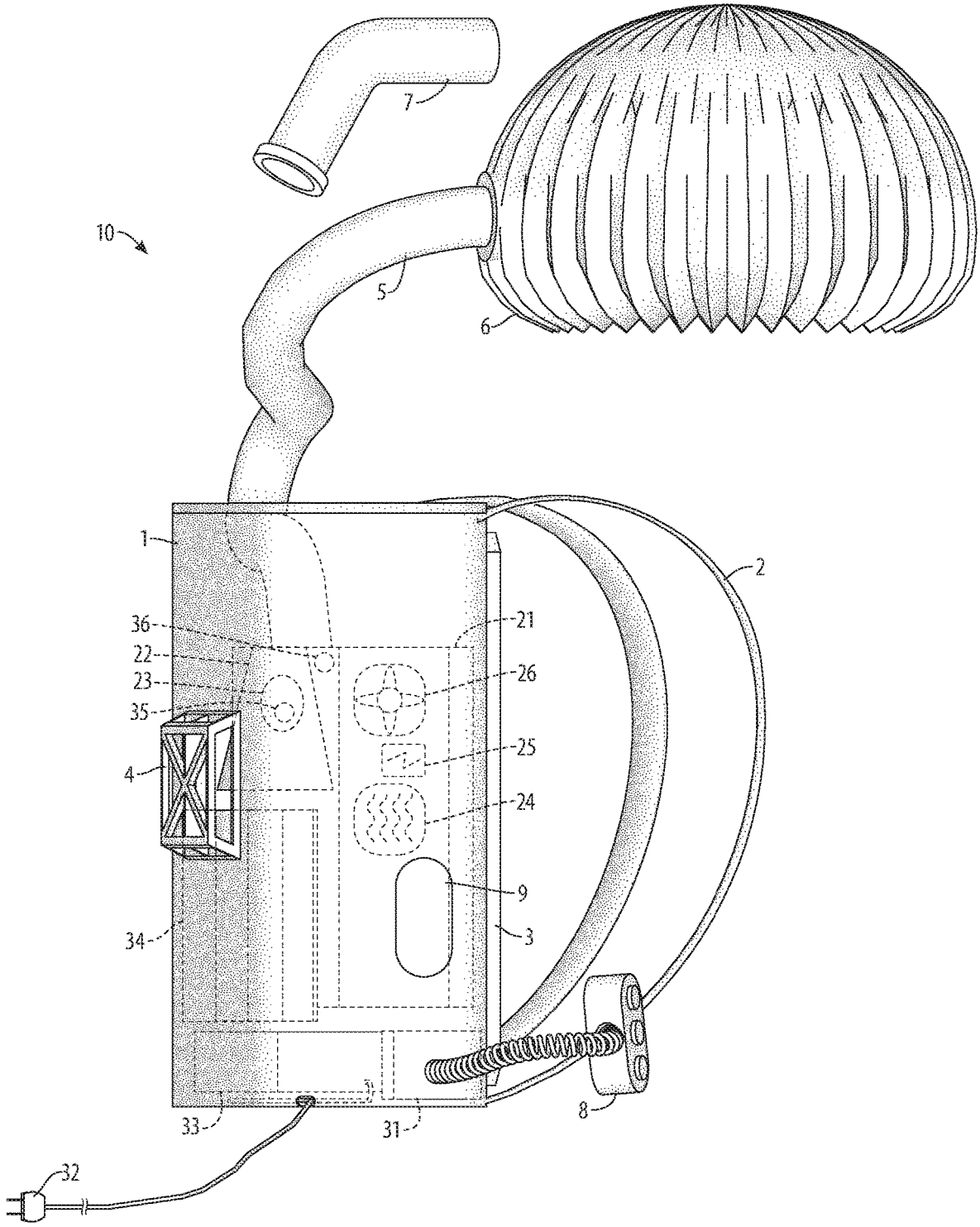
FIG. 1 is a perspective view of the dual-powered portable use hair dryer of the invention in use with a soft-bonnet and a blow-dry nozzle.
Figure 2:
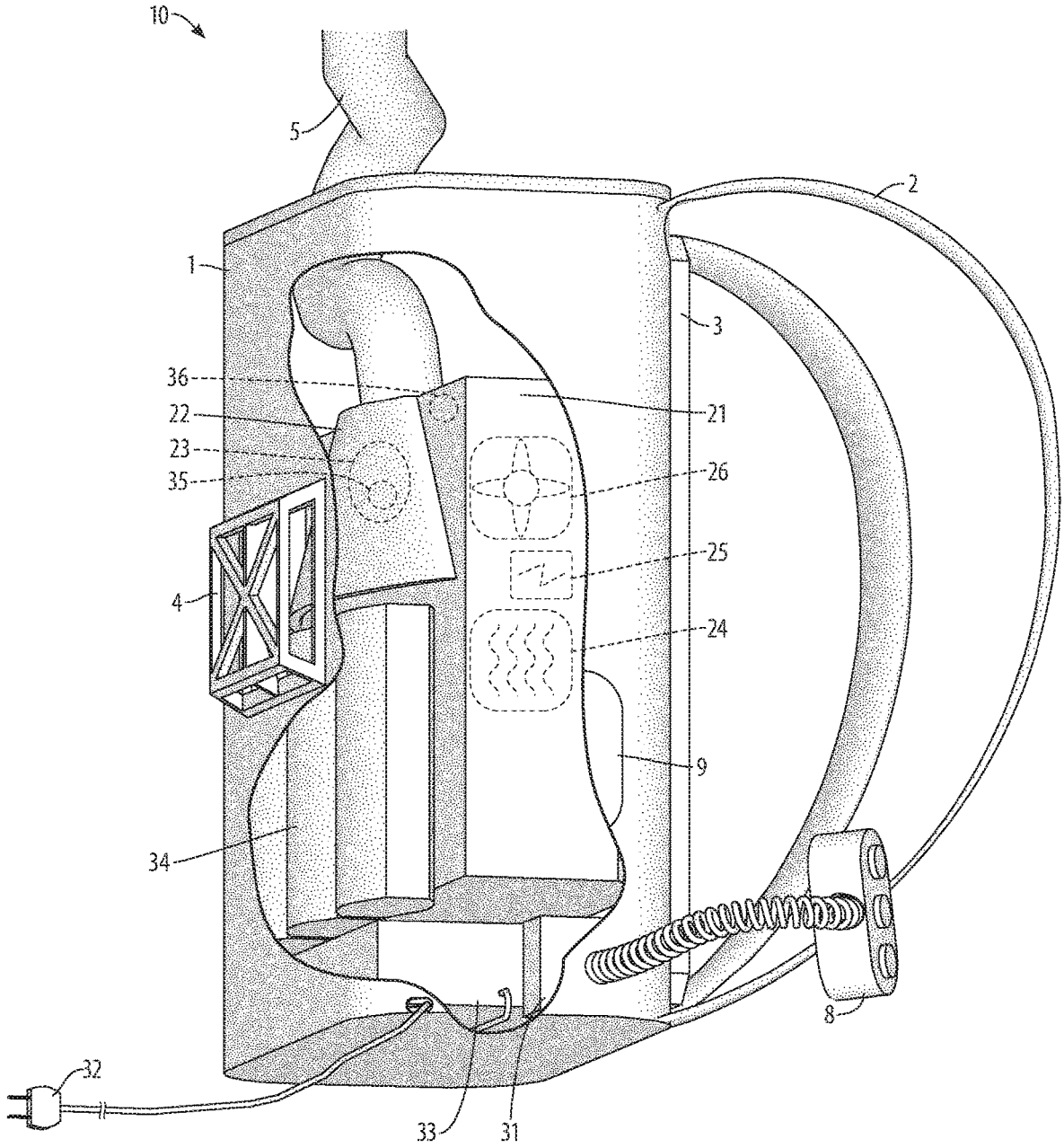
FIG. 2 is a perspective view of the dual-powered portable-use hair dryer of the invention.

Referring to FIG. 1 and FIG. 2, the dual-power portable-use hair dryer 10 of the invention is shown. A pack cover 1 encloses the other components. The pack cover 1 should be lightweight and should function as a backpack or satchel. A canvas or duck material is appropriate. One or more straps 2 extend from the pack cover 1 and allow the dual-power portable-use hairdryer 10 to be worn on the back or carried at the side of the user during operation, allowing the user to move around freely and to use both hands. An insulated standoff 3 on the surface of the pack cover 1 facing the user prevents the transfer of heat to the user. A pack vent 4 is provided to allow air to flow into and out of the pack cover 1. In a preferred embodiment, the pack vent 4 accommodates an air filter. The dual-power portable-use hair dryer 10 can be worn or carried by person whose hair is being dried, or by a different person, such as a stylist, who might need to move from person to person or might need to follow a particular person.

The dual-power portable-use hair dryer 10 provides heated air at controlled temperature and velocity through a flexible air hose 5, which can be fitted with various hair-drying attachments such as the soft bonnet 6 or the blow-dry nozzle 7 as illustrated. Where a soft bonnet 6 is used, the hands of a person wearing the dual-power portable-use hair dryer 10 would be free, and the person would be able to move around extensively. Where the user and wearer of the dual-power portable-use hair dryer 10 is a stylist drying the hair of other people with a blow-dry nozzle 7, such a user would be able to move around extensively. Such extensive movement is allowed because the dual-power portable-use hair dryer 10 can operate on battery power, as disclosed more completely below, freeing the user from being tethered by any connection to AC mains power.

The user controls the operation of the dual-power portable-use hair dryer 10 through a user control 8 which can be attached to a user control mount 9 on the pack cover 1 or can be moved into a more conveniently reached position. In an embodiment, the user control 8 is attached with a low-voltage electric cord, as shown. In another embodiment, the user control 8 can communicate wirelessly.

Inside the pack cover 1, an air handler unit 21 provides heated air at controlled temperature and velocity through the flexible air hose 5. An intake hood 22 upon the air handler unit 21 covers an air intake 23 which draws air into the air handler unit 21. The intake hood 22 is positioned such that air already heated by other electric and electronic components is preferentially drawn into the air intake 23, which assists the cooling of the electric and electronic components while increasing efficiency because the already pre-heated air can be brought up to the desired temperature with less energy expended. Air drawn into the air intake 23 is passed through a heater 24 to be brought up to a specified temperature.

Optionally, air exiting the heater 24 can be ionized by an ionizer 25 of a type known in the art.

Air heated by the heater 24 is drawn through a fan unit 26 having one or more fans, and exits the air handler unit 21 through the flexible air hose 5, at a controlled velocity.

Figure 3:
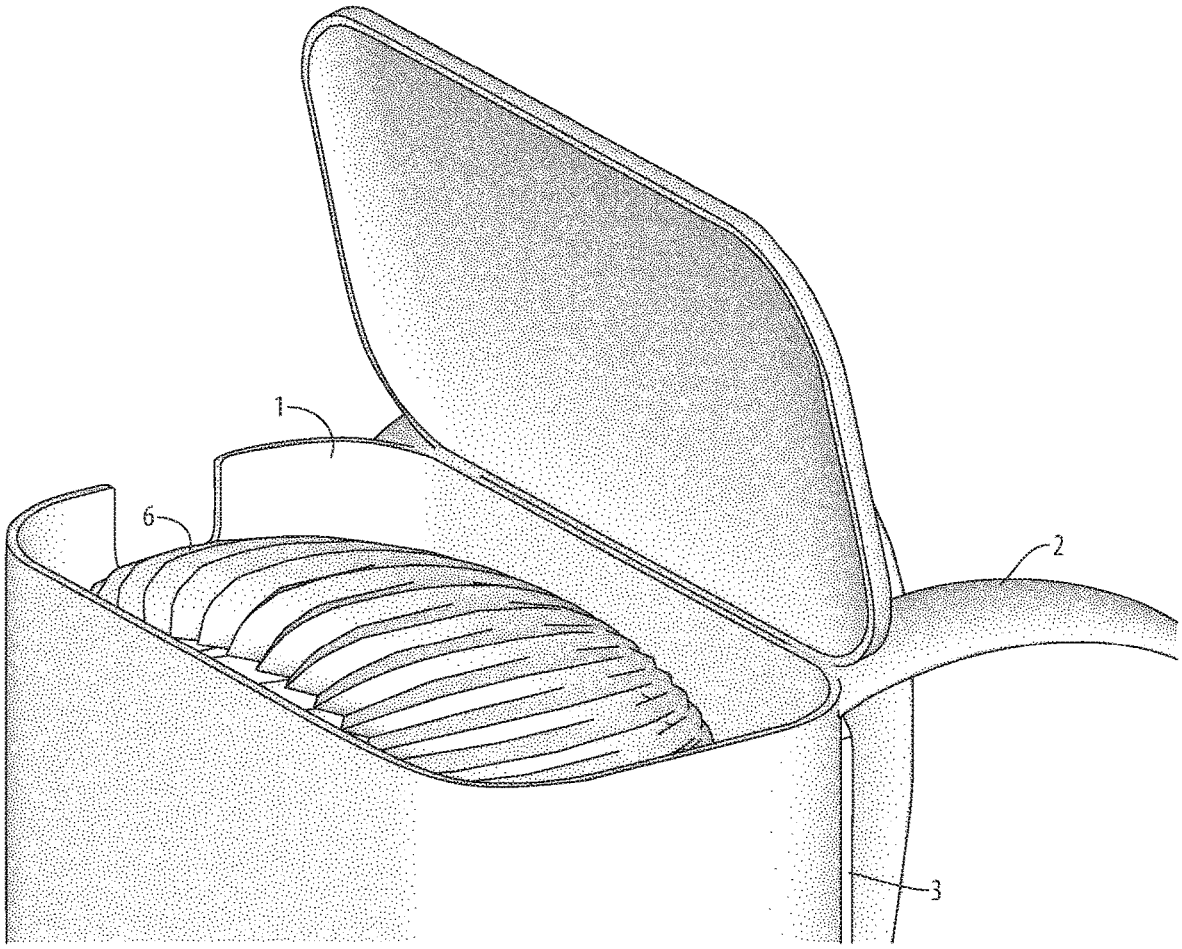
FIG. 3 is a perspective view of the dual-powered portable-use hair dryer of the invention.

Referring to FIG. 3, optionally, extra room can be provided in or on the pack cover 1 for storage of items such as a soft bonnet 6 as shown or a blow-dry nozzle 7 not shown, and for storage of the flexible air hose 5, not shown.

Figure 4:
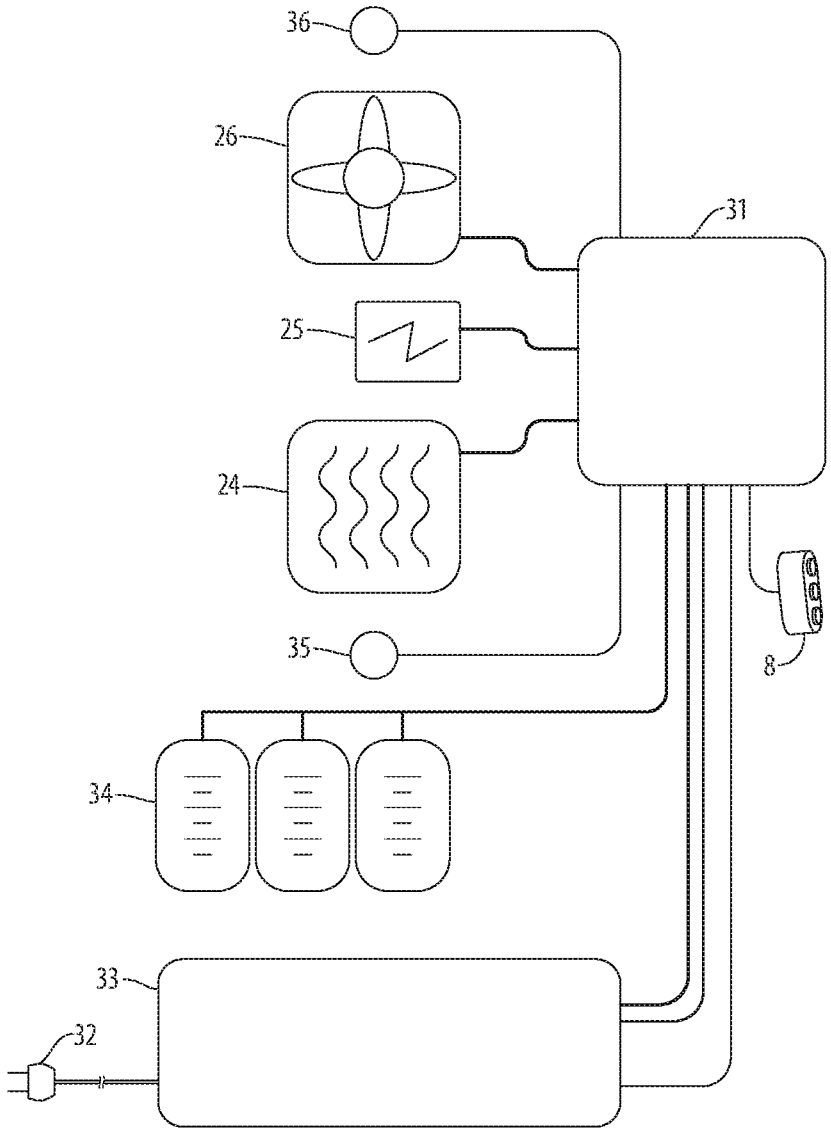
FIG. 4 is a schematic view of control of the dual-powered portable-use hair dryer of the invention in use.

Referring to FIG. 4, the operation of the dual-power portable-use hair dryer 10 is controlled by a controller unit 31, under a user's control through the user control 8.

Electric mains power can be supplied through an AC mains plug 32 to an AC-to-DC power unit 33. Preferably, the AC-to-DC power unit 33 can accommodate mains power of from 110 to 240 volts and either 50 or 60 hertz, by techniques known in the art. The AC-to-DC power unit 33 performs as a full wave bridge rectifier to output DC power at a controllable voltage and amperage, as known in the art. For safety, the AC-to-DC power unit 33 incorporates ground fault circuit interruption (GFCI) and thermal shutdown to prevent overheating, as known in the art. The AC-to-DC power unit 33 also communicates status information to the controller unit 31.

In a preferred embodiment, the AC-to-DC power unit 33 outputs two different DC voltages, one lower and one higher. The lower DC voltage can be in the range of 5-to-12 volts, and can be used for data communications among components and as power for low-voltage components. Buck or boost converters, as known in the art, can be incorporated into the controller unit 31 and can be used to generate 3.3, 5, 9, or 12 volts DC from the lower voltage DC output, if needed. The higher DC voltage output should match the power requirements of the heater and fan, and the capacity of the battery array 34, as disclosed below.

A battery array 34 is provided to allow use of the dual-power portable-use hair dryer in circumstances where AC mains power is not available or where the use does not wish to be tethered in place to an AC mains outlet. The nominal DC voltage of the battery array 34 should match the power requirements of the heater 24 and the fan unit 26, and optionally of an ionizer 25, if present. In a working prototype of the dual-power portable-use hair dryer 10, the nominal capacity of the battery array 34 is 108 volts DC, and the battery array 34 comprises three commercially available battery packs wired in series, each battery pack comprising 20 18650 lithium-ion batteries, and each battery pack having listed values of 36V, 4400 mAh, and 158.4 Wh. Charging and discharging of the battery array 34 is controlled by the controller unit 31, optionally with balancing among the battery packs, using methods known in the art. The power for charging the battery array 34 comes from the AC-to-DC power unit 33. The controller unit 31 also controls whether the dual-power portable-use hair dryer 10 is operating on DC power from the battery array 34 or DC power from the AC-to-DC power unit 33.

An inflow sensor 35 is provided at the air intake 23 enclosed by the intake hood 22, which senses the temperature of the incoming air, which may have been pre-warmed by the electric and electronic components within the pack cover 1. The inflow sensor 35 communicates the temperature information to the controller unit 31. An outflow sensor 36 is provided near where heated air exits the air handler unit 21 and enters the flexible air hose 5. The outflow sensor 36 senses the temperature of the outgoing air and communicates that temperature to the controller unit 31. Optionally the outflow sensor 36 can also sense the pressure or velocity of the heated air exiting the air handler unit 21 and communicate that information to the controller unit 31.

In use of the dual-power portable-use hair dryer 10, when activated by the user through the user control 8, the controller unit 31 uses status information from the AC-to-DC power unit 33 to determine whether power is present at the AC mains plug 32. If AC mains power is present it is used for operation, and if AC mains power is not present, the battery array 34 is used for operation. The controller unit 31 activates the fan unit 26 at a speed set by the user through the user control 8, and air is drawn into the air handler unit 21 through the air intake 23 enclosed by the intake hood 22. The incoming air temperature is sensed by the inflow sensor 35 and is communicated to the controller unit 31, which determines how much heat, if any, should be applied by the heater 24 in order to achieve the temperature set by the user through the user control 8. The controller unit 31 then supplies the heater 24 with the appropriate amount of DC power to achieve the desired heating. If an optional ionizer 25 is present, and if the user activates the ionizer 25 through the user control 8, the appropriate amount of power is supplied to the ionizer 25 by the controller unit 31. Heated air is drawn through the fan unit 26 and is expelled from the air handler unit 21 into the flexible air hose 5. The temperature of the expelled air is sensed by the outflow sensor 36 and is communicated to the controller unit 31. If the temperature of the expelled air does not match the desired temperature set by the user through the user control 8, the controller unit 31 adjusts the amount of power provided to the heater 24. The expelled air flows through the flexible air hose 5 and then through an attachment to the flexible air hose 5 such as the soft bonnet 6 or the blow-dry nozzle 7.

The range of temperature available for selection by the user through the user control 8 is from no heating by the heater 24 up to a maximum safe temperature below the threshold temperature for risk of injury to the user or damage to the equipment. For safety, if the temperature sensed by the outflow sensor 36 exceeds a safe limit above which there is a danger of injury to the user, the controller unit 31 will shut down the dual-power portable-use hair dryer 10 in order to prevent such injury. Preferably, this fail-safe circuitry is implemented separately from the circuitry controlling normal operation, since proper normal operation is not supposed to allow such a high temperature to occur in the first instance.

The air temperatures sensed by the inflow sensor 35 and outflow sensor 36 are continuously monitored by the controller unit 31, and any needed adjustments of power supplied to the heater 24 are continuously made. Because the intake hood 22 is positioned to draw heated air away from the electric and electronic components, including the battery array 34 and the AC-to-DC power unit 33, the otherwise waste heat generated by ongoing operation should pre-heat the incoming air and allow less power to be applied to the heater 24 as operation continues.

In an optional embodiment having an outflow sensor 36 which can also sense pressure or velocity of the expelled air, the controller unit 31 can use the sensed information to make adjustments to the operation of the fan unit 26.

For additional safety, if data communication between the controller unit 31 and any other component is dropped or becomes erratic, the controller unit 31 will shut down the dual-power portable-use hair dryer 10.

During operation of the dual-power portable-use hair dryer 10, the user can make adjustments to the heat and flow speed and can shut down operation through the user control 8. When the dual-power portable-use hair dryer 10 is not plugged into the AC mains, the user can move about freely during operation. Optionally, the user control 8 can provide a shutoff timer function which would be especially useful when using the soft bonnet 6. For safety, and to prevent unattended running, the controller unit 31 can provide a shutoff timer which provides an audio or visual alert and allows for an override through the user control 8 to continue operation.

Many other changes and modifications can be made in the system and method of the present invention without departing from the spirit thereof. I therefore pray that my rights to the present invention be limited only by the scope of the appended claims.

I claim:

1. A dual-power portable-use hair dryer comprising:

(i) a pack cover having at least one strap, an insulated standoff member extending along substantially entire height of a portion of the pack cover and secured to an exterior surface of the pack cover to prevent heat transfer to a user, and a pack vent;

(ii) an air handler unit comprising:

(a) an air intake;

(b) an intake hood covering said air intake, adapted to draw pre-heated air from within said pack cover;

(c) a heater mounted downstream of the air intake and adapted to heat air; and (d) a fan unit adapted to expel heated air;

(iii) a flexible air hose attached to said air handler unit and adapted to receive heated air expelled from said air handler unit and convey heated air to a hair-drying attachment;

(iv) an inflow sensor mounted in said pack cover near said air intake and upstream of the heater, said inflow sensor being adapted to sense the temperature of inflowing air;

(v) an outflow sensor mounted in said pack cover downstream of the inflow sensor and the fan unit, near the place of attachment of said flexible air hose to said air handler unit, adapted to sense the temperature and the pressure of outflowing air before delivery to the hair-drying attachment;

(vi) a battery array adapted to supply DC power;

(vii) an AC-to-DC power unit adapted to convert AC mains power into DC power, and to communicate operational data;

(viii) a user control adapted to receive commands from a user; and (ix) a controller unit adapted to control the charging and discharging of said battery array, adapted to receive data from said user control and said inflow sensor, outflow sensor, and AC-to-DC power unit, and to control operation of said heater and said fan unit, said AC-to-DC power unit and said battery array being separately operationally connected to said controller unit and being configured to receive separate operational signals from the controller unit in response to user's choice of which power source to use when drying hair, and wherein the inflow sensor is configured to sense the incoming air temperature and to communicate to the controller unit for determination of how much heat, if any, should be applied by the heater in order to achieve the temperature set by the user through the user control.

2. The dual-power portable-use hair dryer of claim 1, where said air handler unit further comprises an ionizer mounted downstream of the heater and upstream of the fan unit, and said controller unit being adapted to control operation of said ionizer.

3. The dual-power portable-use hair dryer of claim 1, where said hair-drying attachment is a soft bonnet.

4. The dual-power portable-use hair dryer of claim 1, where said hair-drying attachment is a blow-dry nozzle.

5. The dual-power portable-use hair dryer of claim 1, further comprising a user control mount upon said pack cover.

6. The dual-power portable-use hair dryer of claim 1, where said outflow sensor is further adapted to sense the velocity of outflowing air.

7. The dual-power portable-use hair dryer of claim 1, where said pack cover further comprises being adapted to provide storage space for said hair-drying attachments.

8. The dual-power portable-use hair dryer of claim 1, where said battery array has a capacity of at least 70 DC volts.

9. The dual-power portable-use hair dryer of claim 1, where said battery array has a capacity of at least 100 DC volts.

* * * * *